US007140911B1

(12) United States Patent
Rector et al.

(10) Patent No.: US 7,140,911 B1
(45) Date of Patent: Nov. 28, 2006

(54) METHOD AND APPARATUS FOR AGGREGATING CABLE CONNECTORS

(75) Inventors: Jack Rector, San Ramon, CA (US); Saeed Seyed, Los Altos Hills, CA (US); Lucia Cafiero, Palo Alto, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/167,660

(22) Filed: Jun. 27, 2005

(51) Int. Cl.
*H01R 13/60* (2006.01)
*H01R 13/66* (2006.01)

(52) U.S. Cl. ..... 439/540.1; 439/49

(58) Field of Classification Search ..... 439/540.1, 439/353, 923, 344, 701, 355, 367
See application file for complete search history.

(56) References Cited

U.S. PATENT DOCUMENTS 6,123,564 A * 9/2000 Belmore, III ..... 439/344
6,547,585 B1 * 4/2003 Bradley et al. ..... 439/353
6,561,838 B1 5/2003 Blichfeldt ..... 439/418
6,648,652 B1 11/2003 Nakano et al. ..... 439/55
6,783,391 B1 * 8/2004 Schlueter et al. ..... 439/540.1
6,796,844 B1 * 9/2004 Edwards, III ..... 439/638
6,857,900 B1 * 2/2005 Kleeberger et al. ..... 439/540.1
6,953,368 B1 10/2005 Khemakhem et al. ..... 439/668
6,964,578 B1 11/2005 Clark et al. ..... 439/320

* cited by examiner

*Primary Examiner*—Hae Moon Hyeon
(74) *Attorney, Agent, or Firm*—BainwoodHuang

(57) ABSTRACT

A connector module collects or aggregates a group of cables having cable connectors, such as RJ45 connectors, into a single unit. With such aggregation, the connector module allows attachment or detachment of multiple cable connectors with multiple connector ports of a network interface circuit board at substantially the same time (e.g., during a single installation or removal procedure). The connector module, therefore, minimizes the amount time needed to install or remove individual cable relative to the network interface circuit board. Also, the connector module maintains the positioning of the connectors relative to the connector ports. Therefore, an operator can remove the connector module from the ports without having to track the positioning of individual cables and individual cable connectors relative to particular ports of the network interface circuit board.

17 Claims, 8 Drawing Sheets

METHOD AND APPARATUS FOR AGGREGATING CABLE CONNECTORS

BACKGROUND

Conventional computer interface devices, such as network interface circuit boards, provide a physical connection between a cable and an internal bus of a computerized device. Connection of the cable to the computer interface device allows data transference (e.g., data reception and data transmission) with external computerized devices. The cable includes a connector that inserts or "plugs into" a port of the computer interface device. The physical configuration of the port depends, in part, on the intended use of the port.

Certain computer interface device ports are configured as serial communication ports, such as for transmission of printer signals to a printer. The serial communication ports connect to cables having D-Subminiature (e.g., D-Sub) connectors. The D-Sub connectors include a series of pins in a single housing that insert within associated pin receptacles of the serial communication port. Connection of a cable having D-sub connectors between the serial communication port of a printer interface circuit board and a printer enables the printer to receive the printer signal from the printer interface circuit board.

Other computer interface device ports are configured as telecommunication type ports (e.g., such as for Internet connections) that connect to cables having latched cable connectors. For example, line cards that transmit and receive data via standard Cat5 cables having latched RJ45 connectors include groups of ports that physically and electrically connect to the RJ45 connectors. The conventional line cards include collections or groups of such ports or receptacles where each port connects to a single RJ45 connectors of a single cable. To allow communication between a computerized device having the line card and multiple external computer devices, each port of the line card requires connection to a separate cable and cable connector.

SUMMARY

Line cards, as described above, can have up to 48 individual ports. Computers having such interface devices or line cards present, to operators of the computers, cable management concerns. For example, in order to replace a line card in a computer system, where the line card connects to multiple cables and cable connectors, the operator must remove all of the cable connectors from the line card. For line cards having up to 48 individual ports and associated cable connections, such removal is a relatively time intensive process. Also, when removing line card, the operator must track the position or correspondence of each of the connectors relative to the ports of the line card. By tracking such relative positioning, the operator ensures that, when the user replaces the line card with a second line card, the operator inserts each of the connectors in the appropriate (e.g., corresponding) ports of the second line card. However, for line cards having up to 48 individual ports, an operator can lose track of the correspondence between certain cable connectors and certain ports, thereby increasing the chances that the operator connects a cable to an incorrect port.

In contrast to the conventional approach for installing and removing cables and cable connectors relative to a line card, embodiments of the invention are directed to techniques for managing and handling groups of cables and cable connectors. A connector module collects or aggregates a group of cables having cable connectors, such as RJ45 connectors, into a single unit. With such aggregation, the connector module allows attachment or detachment of multiple cable connectors with multiple connector ports of a network interface circuit board at substantially the same time (e.g., during a single installation or removal procedure). The connector module, therefore, minimizes the amount time needed to install or remove individual cable relative to the network interface circuit board. Also, the connector module maintains the positioning of the connectors relative to the connector ports. Therefore, an operator can remove the connector module from the ports without having to track the positioning of individual cables and individual cable connectors relative to particular ports of the network interface circuit board.

In one arrangement, a connector module assembly has a plurality of cables where each of the plurality of cables has a corresponding cable connector. The connector module assembly has a frame defining a plurality of openings where each cable connector of the plurality of cables inserts within a corresponding opening of the plurality of openings defined by the frame. The connector module assembly also has a housing coupled to the frame where the housing contains the plurality of cables. The housing and the frame aggregate the plurality of cables to allow engagement and disengagement of the cables, relative to corresponding connector ports, as a unit. The connector module assembly minimizes time needed to install or remove cables and cable connectors to or from a network interface circuit board, relative to the time necessary to install or remove individual, non-aggregated cables and cable connectors.

The features of embodiments of the invention, as described above, may be employed in electronic equipment and methods such as those of Cisco Systems of San Jose, Calif.

BRIEF DESCRIPTION OF THE DRAWINGS

The foregoing and other objects, features and advantages of embodiments of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

Embodiments of the present invention are directed to techniques for managing and handling groups of cables and cable connectors. A connector module collects or aggregates a group of cables having cable connectors, such as RJ45 connectors, into a single unit. With such aggregation, the connector module allows attachment or detachment of multiple cable connectors with multiple connector ports of a network interface circuit board at substantially the same time (e.g., during a single installation or removal procedure). The connector module, therefore, minimizes the amount time needed to install or remove individual cable relative to the network interface circuit board. Also, the connector module maintains the positioning of the connectors relative to the connector ports. Therefore, an operator can remove the connector module from the ports without having to track the positioning of individual cables and individual cable connectors relative to particular ports of the network interface circuit board.

Figure 1:
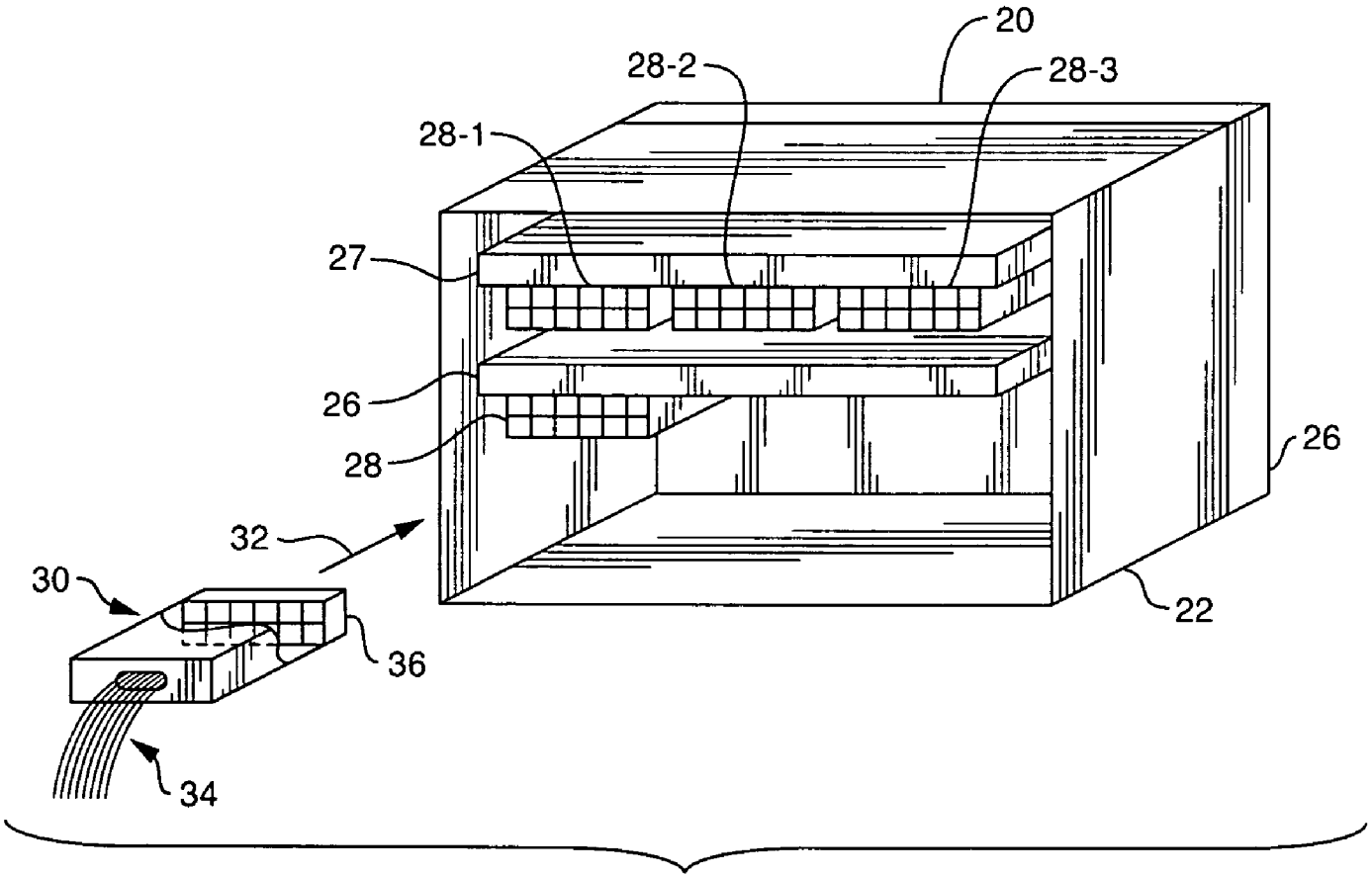
FIG. 1 is a perspective view of a computer system having a connector module assembly.

FIG. 1 shows a computer system 20 having a card cage 22, a back plane 24, network interface circuit boards 26, and a connector module assembly 30.

The network interface circuit boards 26 electrically couple with the back plane 24. The network interface circuit boards 26 include ports 28 adapted to receive cable connectors of the connector module assembly 30, thereby allowing transmission of electrical signals (e.g., data signals) from the computer system 20 (e.g., through a network interface circuit board 26, the ports 28 and the connector module assembly 30) to an external computerized device.

The connector module assembly 30 aggregates a collection of cables 34 and associated cable connectors 36 into a single unit. With such aggregation, the connector module assembly 30 allows attachment of multiple cables to, or detachment of multiple cables from, a network interface circuit board 26 at once (e.g., during a single installation or removal procedure). For example, as the connector module assembly 30 couples to the network interface circuit board 26 along direction 32, the connector module assembly 30 creates electrical connections with the network interface circuit board 26, via interconnection of the connectors 36 and the ports 28, during a single installation procedure.

Figure 2:
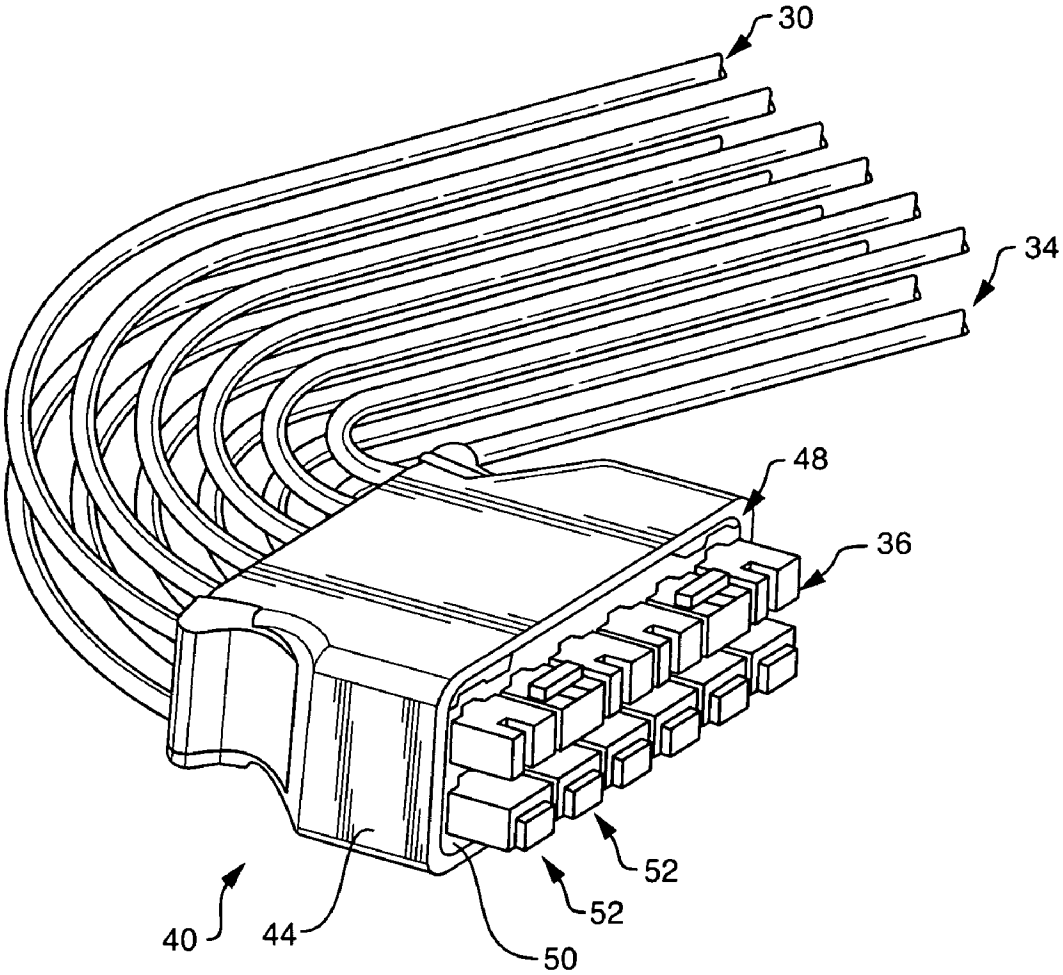
FIG. 2 illustrates a perspective view of an arrangement of the connector module assembly of FIG. 1.
Figure 3A:
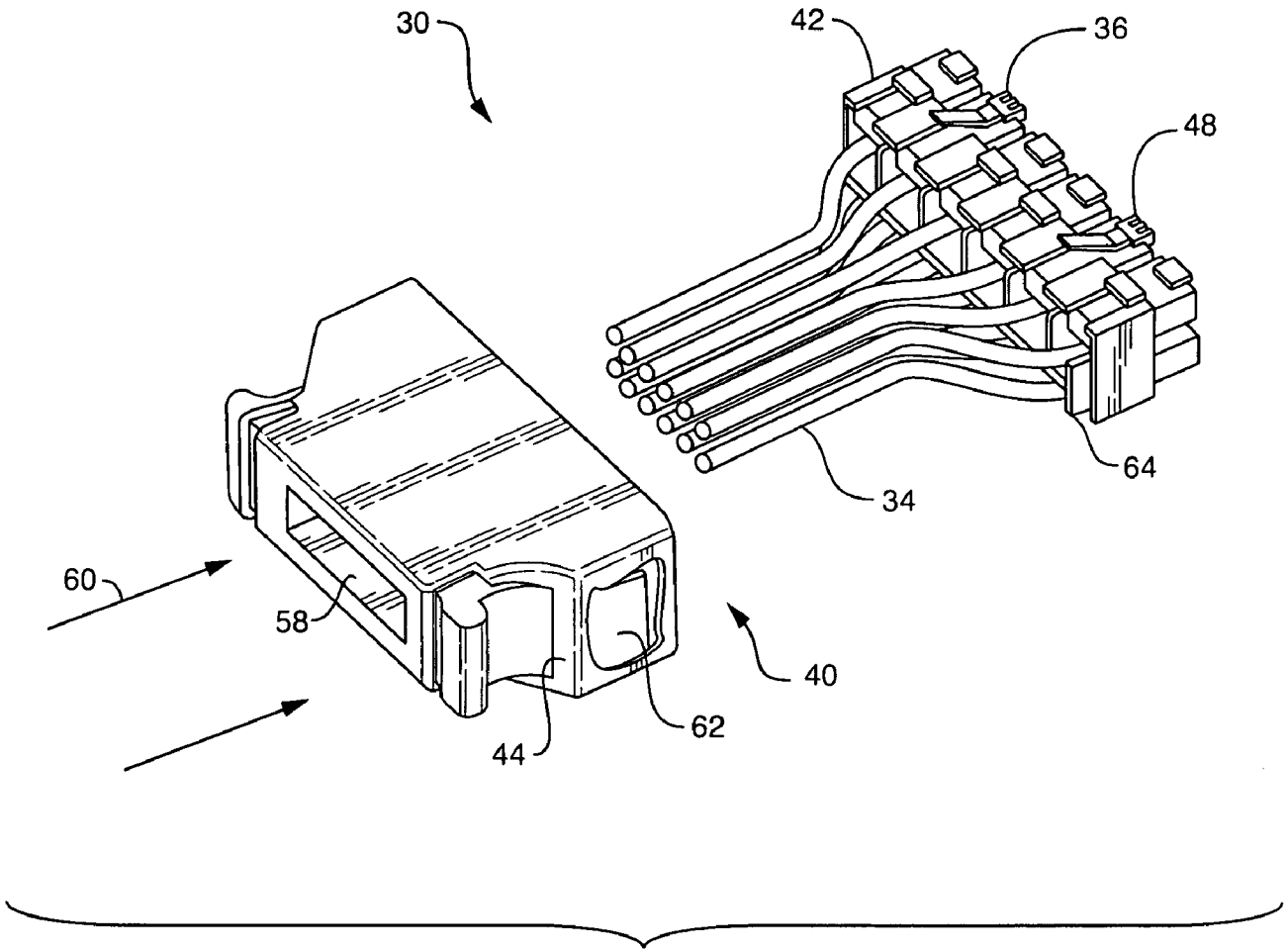
FIG. 3A illustrates a view of a frame, cable connectors, and housing of the connector module assembly of FIG. 2.
Figure 3B:
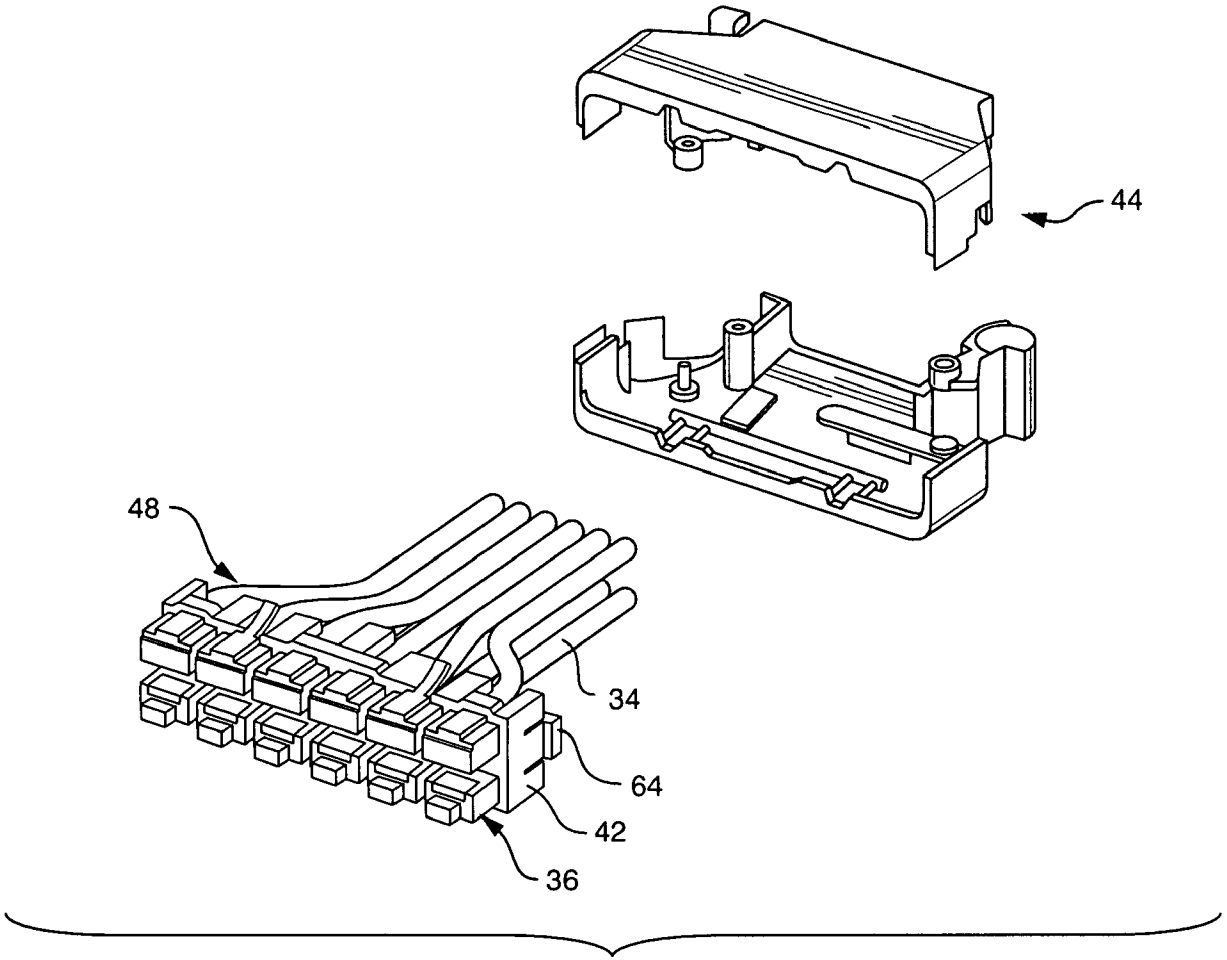
FIG. 3B illustrates an exploded view of a frame, cable connectors, and housing of the connector module assembly of FIG. 2.

FIGS. 2, 3A, and 3B illustrate an arrangement of the connector module assembly 30. The connector module assembly 30 includes a connector module 40 and cables 34 having cable connectors 36, such as RJ45 connectors or RJ11 connectors. The connector module includes a frame 42 and a housing 44 to collect or bundle the cables 34 and connectors 36 as a unit.

Figure 4:
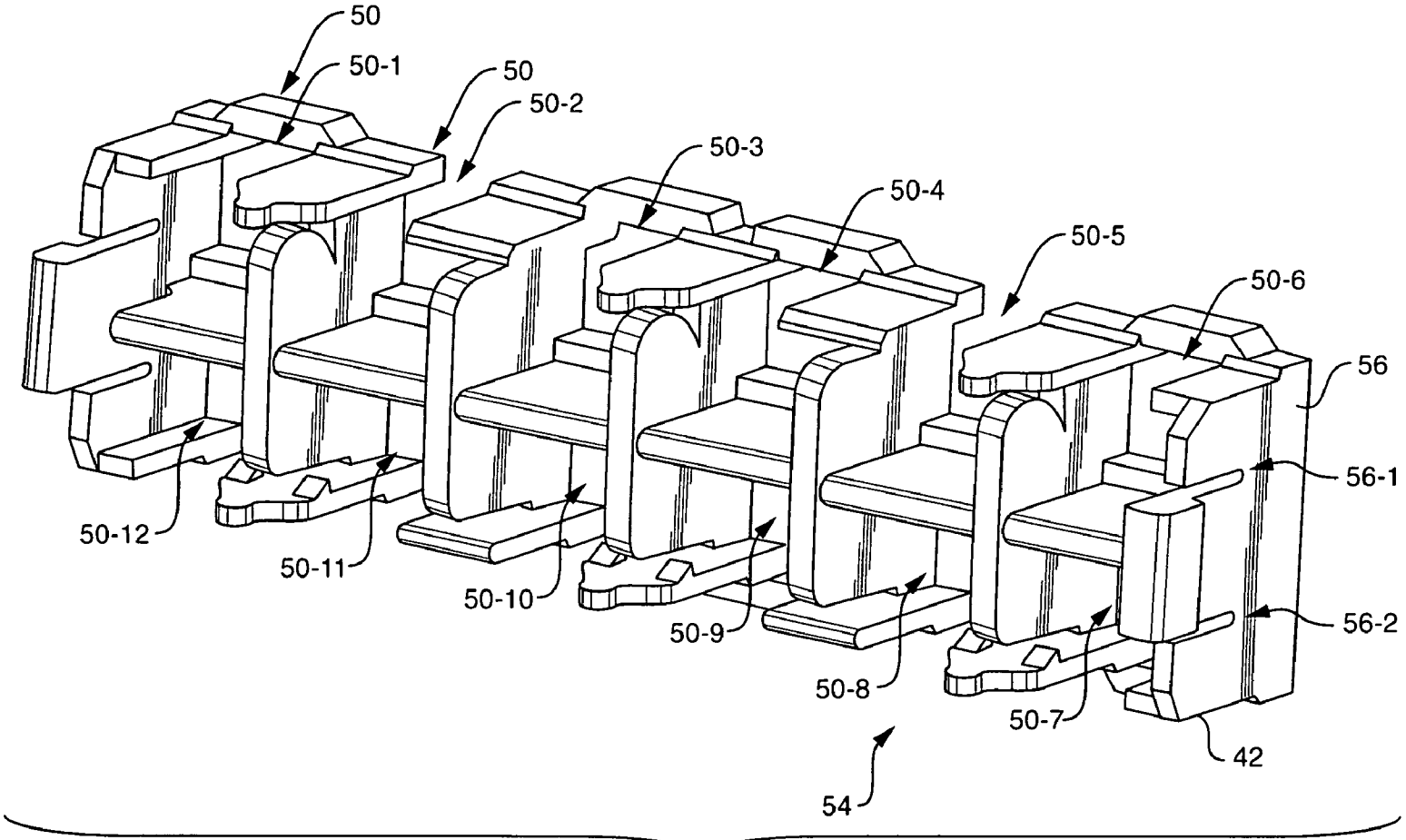
FIG. 4 illustrates a perspective view of a frame of the connector module assembly of FIG. 2.

The frame 42 collects a series of cable connectors 36 such that, once collected or aggregated, the connectors 36 attach to, or detach from, associated ports 28 as a single unit. As illustrated in FIG. 4, the frame 42 defines a plurality of openings 50. Each opening 50, as defined by the frame 42, receives a corresponding cable connector 36 as indicated in FIGS. 3A and 3B. As the connectors 36 insert within the openings 50, the connectors 36 secure or "lock into" the frame 42.

As shown in FIG. 4, the frame 42 defines the openings 50 in a matrix pattern 54. For example, as illustrated, the frame 42 defines two rows 56 of openings 50, each row having six openings 50 (e.g., openings 50-1 through 50-6 in a first row 56-1 and openings 50-7 through 50-12 in a second row 56-2). Such a matrix pattern 54 corresponds to an arrangement of ports 28 found on conventional network interface circuit boards 26 (e.g., as illustrated in FIG. 1).

Returning to FIG. 2, as the frame 42 receives the connectors 36 via the openings 50, the frame 42 substantially aligns leading faces 52 of the connectors 36 along a single plane. With the faces 52 of the connectors 36 aligned along a single plane, electrical contacts of all of the connectors 36 align with corresponding electrical contacts of the associated ports 28 of a network interface circuit board 26. As a user inserts the connectors 36 of the connector module assembly 30 within the ports 28, alignment of the faces of the connectors 26 as provided by the frame 42, therefore, allows proper electrical communication between the electrical contacts of all of the connectors 36 and the electrical contacts of the associated ports 28

Returning to FIGS. 2, 3A, and 3B, the housing 44 couples to the frame 42 to cover the frame 42 and to secure the ends of the cables 34 located in proximity to the connectors 36. For example, the housing 44 defines an opening 58 that surrounds the cables 34 when the housing 44 couples to the frame 42. For example, in FIG. 3A, during assembly, the cables 34 insert within the opening 58. As the housing 44 moves along direction 60 and attaches to the frame 42, the opening 58 defined by the housing 44 groups or bundles the cables 34 together as a unit. The opening 58 of the housing 44 secures the ends of the cables 34 located in proximity to the connectors 36 to minimize relative movement of the cables 34 and thereby maintain the orientation of the connectors 36 within the frame 42. As such, the opening 58 limits electrical decoupling of the connectors 36 from the associated ports 28, such as caused by movement of the cables 34.

The connector module 40 aggregates the cables 34 and associated cable connectors 36 into a single unit. With such aggregation, the connector module assembly 30 allows attachment of multiple cables to, or detachment of multiple cables from, a network interface circuit board 26 at substantially the same time (e.g., during a single installation or removal procedure). The connector module assembly 30, therefore, minimizes the amount time needed to install or remove cables 34 and cable connectors 36 to or from the network interface circuit board 26 (e.g., relative to the time necessary to install or remove individual, non-aggregated cables 34 and cable connectors 36.

In one arrangement, the housing 44 detachably couples to the frame 42. For example, as illustrated via the cutaway in FIG. 3A, the housing 44 includes retention mechanism 62, such as a user-actuateable latch. The frame 42, as illustrated in FIG. 3B includes a retention mechanism support 64, such as a latch receptacle. During assembly, as an assembler moves the housing 44 along direction 60, the retention mechanism 62 (e.g., latch) of the housing 44 engages the retention mechanism support 64, (e.g., the latch receptacle) of the frame 42. Such engagement of the retention mechanism 62 of the housing 44 relative to the retention mechanism support 64 of the frame 42 secures or couples the housing to the frame 42. During disassembly, a user actuates the retention mechanism 62 using an actuator (not shown), for example, to separate the retention mechanism 62 from the retention mechanism support 64 and detach or decouple the housing 44 from the frame 42. In the event of a failure of a individual cable 34 or connector 36 during operation, with the housing 44 detachably coupled to the frame 42, a user can detach the housing 44 from the frame 42 to remove the failed cable 34 from the corresponding port 28 without having to remove the entire connector module assembly 30 from the network interface circuit board 26.

Returning to FIG. 2, the cables 34 and cable connectors 36, such as RJ45 connectors or RJ11 connectors, allow transmission of electrical signals (e.g., data signals) between a computer system (e.g., through a network interface circuit board, ports, and connector module 40) to an external computerized device. In one arrangement, the cable connectors 36 include latches 48 that are configured to mate with a cable connector receptacle to lock or secure the connector 36 and cable 34 in place relative to the receptacle. Each of the latches 48, for example, is configured as a leaf spring that bias toward an open or expanded position. When inserted within a cable connector receptacle, such as a port 28, the cable connector receptacle compresses the latch 48 causing the latch 48 to exert a force against the receptacle to secure the connector 36 and associated cable 34 to the receptacle.

Figure 5:
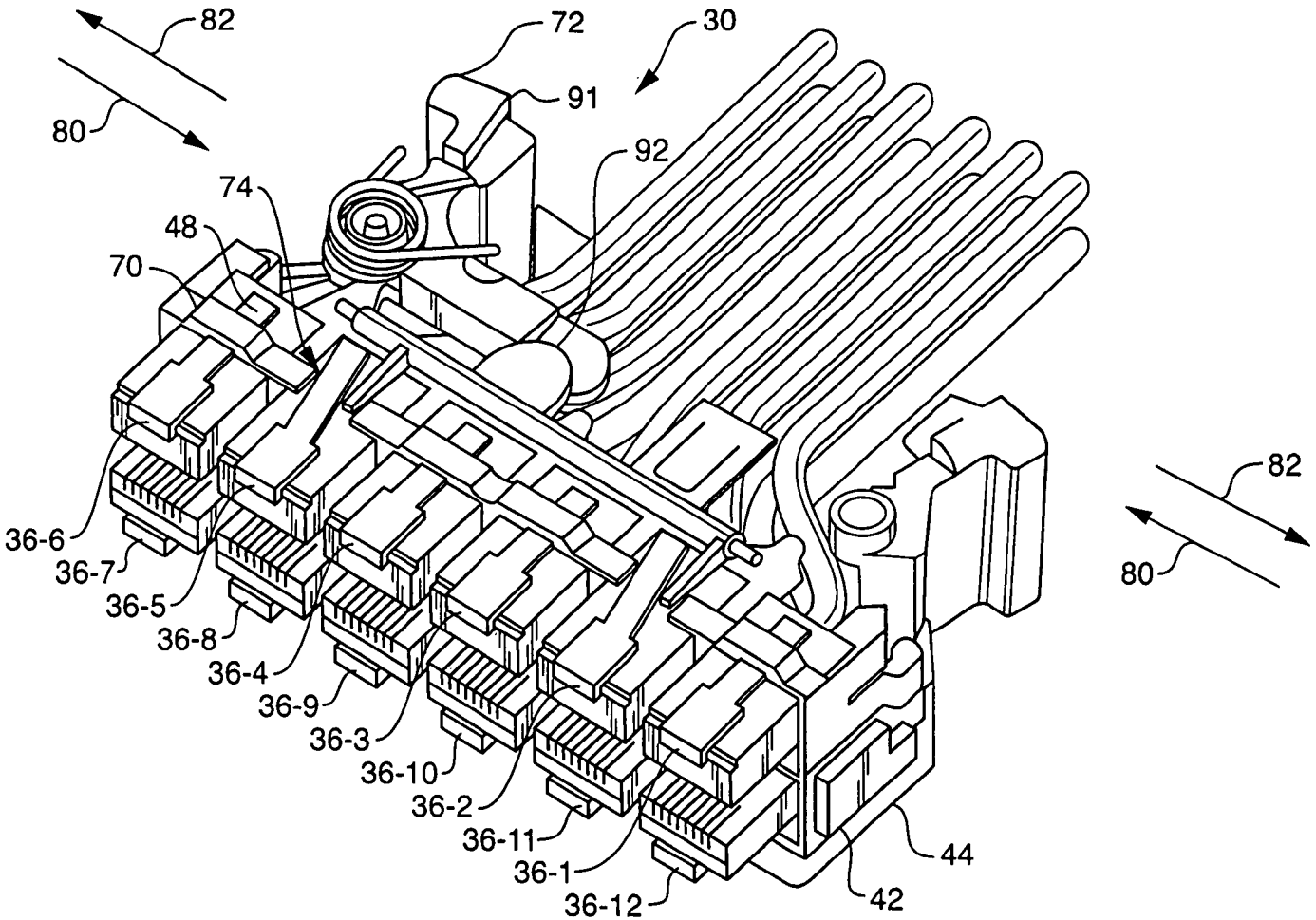
FIG. 5 illustrates a perspective view of the frame and cable connectors of the connector module assembly of FIG. 2.

In one arrangement, the frame 42 and the housing 44 operate in conjunction with each other to position or orient the latches 48 of the connectors 36, relative to the frame 42, to allow physical coupling and decupling of the cable connectors 36, as a unit, relative to a group of ports 28. FIG. 5 illustrates an arrangement of a connector module assembly 30 where the frame 42 includes a latch locking mechanism 70 and the housing 44 includes a lever 72. As will be described, the combination of the latch locking mechanism 70 and the lever 72 limits the number of individual connector latches 48 that need to be actuated during installation or removal of the connector module assembly 30 with the group of ports 28. The combination of the lever 72 and the latch locking mechanism 70 minimizes the possibility for "snagging" of one or more of the latches 48 of the connectors 36 relative to the ports 28 during attachment or detachment.

As illustrated in FIG. 5, the latch locking mechanism 70 contacts certain latches 48 of the connectors 46 inserted within the frame 42 to retain the latches 48 in an engaged or depressed state relative to the frame 42 and relative to the connector ports 28. For example, as illustrated in FIG. 5, the frame 42 holds a series of connectors 36-1 through 36-12. As shown, the latch locking mechanism 70 engages and depresses the latches 48 of a first connector 36-1, a third connector 36-3, a fourth connector 36-4, and a sixth connector 36-6. While not shown in FIG. 5, the latch locking mechanism 70 also engages and depresses the latches 48 of a seventh connector 36-7, a ninth connector 36-9, a tenth connector 36-10, and a twelfth connector 36-12. The latch locking mechanism 70 maintains the latches 48 of the connectors 36-1, 36-3, 36-4, 36-6, 36-7, 36-9, 36-10, and 36-12 in an engaged or depressed state relative to the frame 42. The latch locking mechanism 70, therefore, reduces the need for the latches 48 of the connectors 36-1, 36-3, 36-4, 36-6, 36-7, 36-9, 36-10, and 36-12 to be actuated during attachment or detachment of the connector module assembly 30 to the ports 28.

The latch locking mechanism 70 also defines slots 74 that minimally impinge the latches 48 of certain connectors 36 as the connectors 36 reside within the frame 42. As such, the slots 74 defined by the latch locking mechanism 70 allow the latches 48 of the certain connectors 36 to orient in an expanded state relative to the frame 42. For example, as illustrated in FIG. 5, the latch locking mechanism 70 defines slots 74 that allow the latches 48 of a second connector 36-2 and a fifth connector 36-5 to orient in an expanded state relative to the frame 42. While not shown in FIG. 5, the latch locking mechanism 70 also defines slots 74 that allow the latches 48 of an eighth connector 36-8 and an eleventh connector 36-11 to orient in an expanded state relative to the frame 42. The slots 74, defined by the latch locking mechanism 70, allow the latches 48 to position relative to the lever 72 of the housing 44. The lever 72 operates to actuate the latches of the connectors 36-2, 36-5, 36-8, and 36-11 to insert or remove the connector module assembly 30 relative to the ports 28 of the network interface circuit board 26.

For example, in one arrangement, to insert the connector module assembly 30 into ports 28 of a network interface circuit board 26, a user actuates the lever 72, such as along direction 80. Actuation of the lever 72 compresses the latches 48 of the connectors 36-2, 36-5, 36-8, and 36-11 relative to the frame 42. With such compression, the latches 48 of the connectors 36-2, 36-5, 36-8, and 36-11 orient in a similar manner to the orientation of the connectors 36-1, 36-3, 36-4, 36-6, 36-7, 36-9, 36-10, and 36-12 (e.g., as depressed by the latch locking mechanism 70). With the latches 48 of all of the connectors 36-1 through 36-12 compressed relative to the frame 42 and relative to a series of ports 28, the connectors 36-1 through 36-12 insert within the corresponding ports 28 in a substantially non-impinged manner (e.g., the latches 48 of the connectors 36-1 through 36-12 do not contact the ports during an insertion procedure).

Once the connector module assembly 30 inserts within the ports 28 of the network interface circuit board 26, the user releases the lever 72, such as along direction 82. Release of the lever 72 causes the latches 48 of the connectors 36-2, 36-5, 36-8, and 36-11 to expand relative to the frame 42 to lock or secure the connector module assembly 30 to the ports 28 of the network interface circuit board 26. To remove the connector module assembly 30 from the network interface circuit board 26, the user actuates the lever 72 along direction 82 to compresses the latches 48 of the connectors 36-2, 36-5, 36-8, and 36-11 relative to the frame 42. Such compression decouples or unlocks the latches 48 of the connectors 36-2, 36-5, 36-8, and 36-11 from the ports 28 of the network interface circuit board 26 and allows the user to remove the connector module assembly 30 from the network interface circuit board 26.

The use of the lever 72 in conjunction with the latch locking mechanism 70, as described above, minimizes the necessity for actuation of all of the latches 48 of all of the connectors 36 of the connector module assembly 30 to attach or detach the connector module assembly 30 to or from the network interface circuit board 26. As such, by limiting the number of connector latches actuated during an installation or removal procedure, the combination of the lever 72 and the latch locking mechanism 70 minimizes the possibility for "snagging" of one or more of the connectors 36 (e.g., latches 48 of the connectors 36) in the ports during attachment or detachment.

In one arrangement, the lever 72 includes two separate linkage members configured to compresses the latches 48 of certain connectors during a connector module assembly 30 installation or removal procedure.

Figure 6:
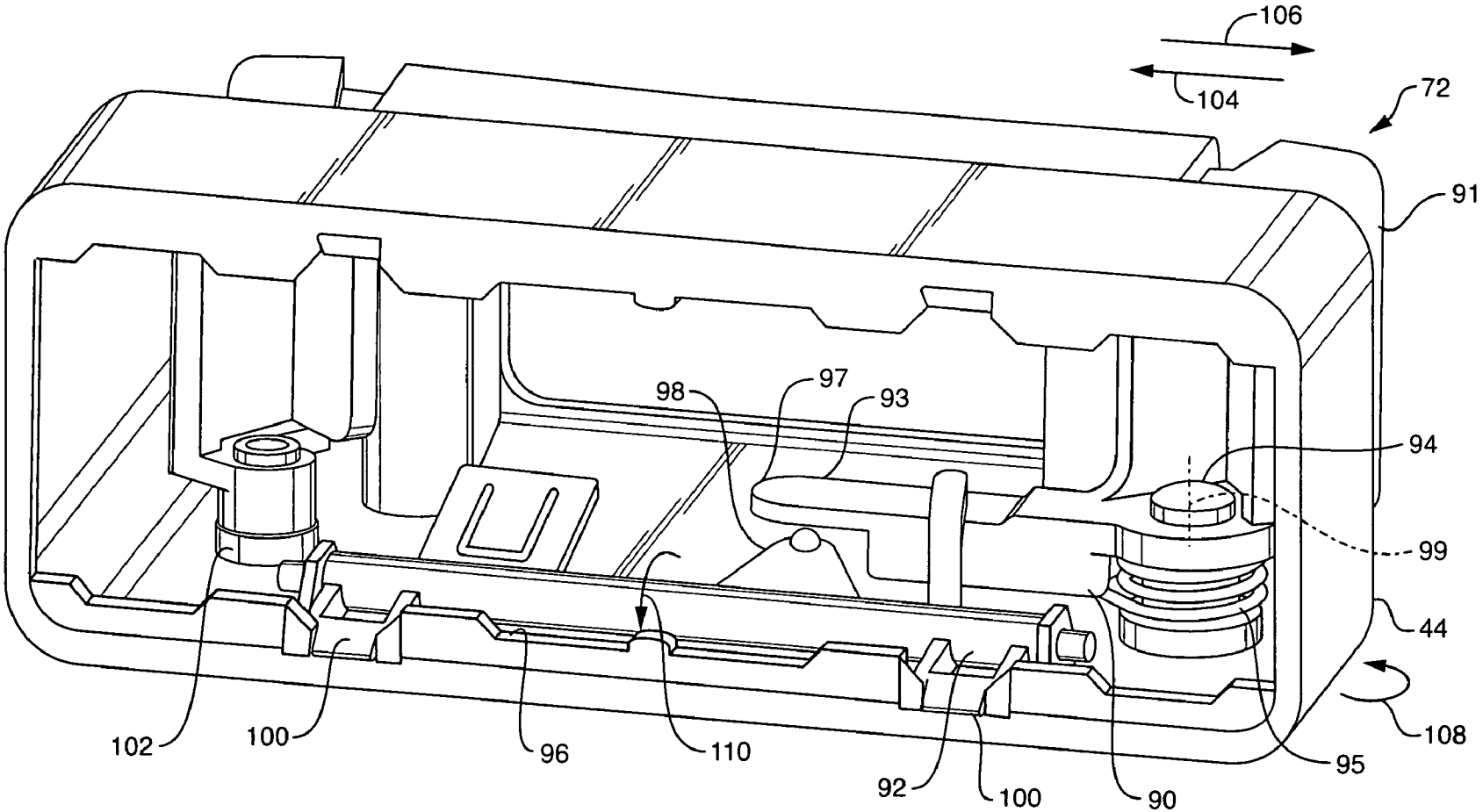
FIG. 6 illustrates an arrangement of a lever mechanism of the connector module assembly of FIG. 2.

FIGS. 5 and 6 illustrate the lever 72 having a first linkage member 90 and a second linkage member 92. The first linkage member 90 includes an actuator 91 and an arm 93 and rotatably couples to the housing 44 via pivot member 94. The first linkage member is adapted to rotate about an axis of rotation 99 (e.g., about the pivot member 94) relative to the frame 44. A proximal portion of the arm 93 defines an inclined surface 97 (e.g., inclined relative to a plane defined by the arm 93) that contacts the second linkage member 92.

The second linkage member 92 includes a shaft 96 having a first linkage contact member 98 and a latch contacting member 100. The first linkage contact member 98 contacts the inclined surface 97 of the proximal portion of the arm 93. The latch contacting member 100, for example, includes latch contacting members 100-1, 100-2 that orient in proximity to the latches 48 of connectors 36-5 and 36-2, respectively, shown in FIG. 5. The second linkage member 92 rotatably couples to the housing 44 and is configured to rotate about an axis of rotation relative to the frame 44. The axis of rotation 102 of the second linkage member 92 orients substantially perpendicular to the axis of rotation 99 of the first linkage member 90.

Assume a case where the connector module assembly 30 couples to a network interface circuit board 26 by way of ports 28. To disengage the connector module assembly 30 from a network interface circuit board 26 of, a user depresses the actuator 91 of the first linkage member 90 along direction 104 to overcome a spring force exerted by the spring 95 on the first linkage member 90. As the first linkage member 90 rotates along direction 108 and about the axis of rotation 99, the inclined surface 97 of the arm 93 depresses the first linkage contact member 98 of the second linkage member 92. In turn, the shaft 96 of the second linkage member 92 rotates along direction 110 and about the axis or rotation 102, causing the latch contacting members 100-1, 100-2 to depress the latch 48 of the connectors 36-5 and 36-2. With the latch 48 of the connectors 36-5, 36-2 depressed relative to the frame 42 and relative to a series of ports 28, a user can remove the connector module assembly 30 from the ports 28.

In certain cases, a network interface circuit board 26 includes multiple sets of ports 28. For example, as shown in FIG. 1, the network interface circuit board 27 includes a first set of ports 28-1, a second set of ports 28-2, and a third set of ports 28-3. In such a configuration, the network interface circuit board 27 can receive three connector module assemblies 30, each connector module assemblies 30 oriented in a side-by-side manner.

Figure 7:
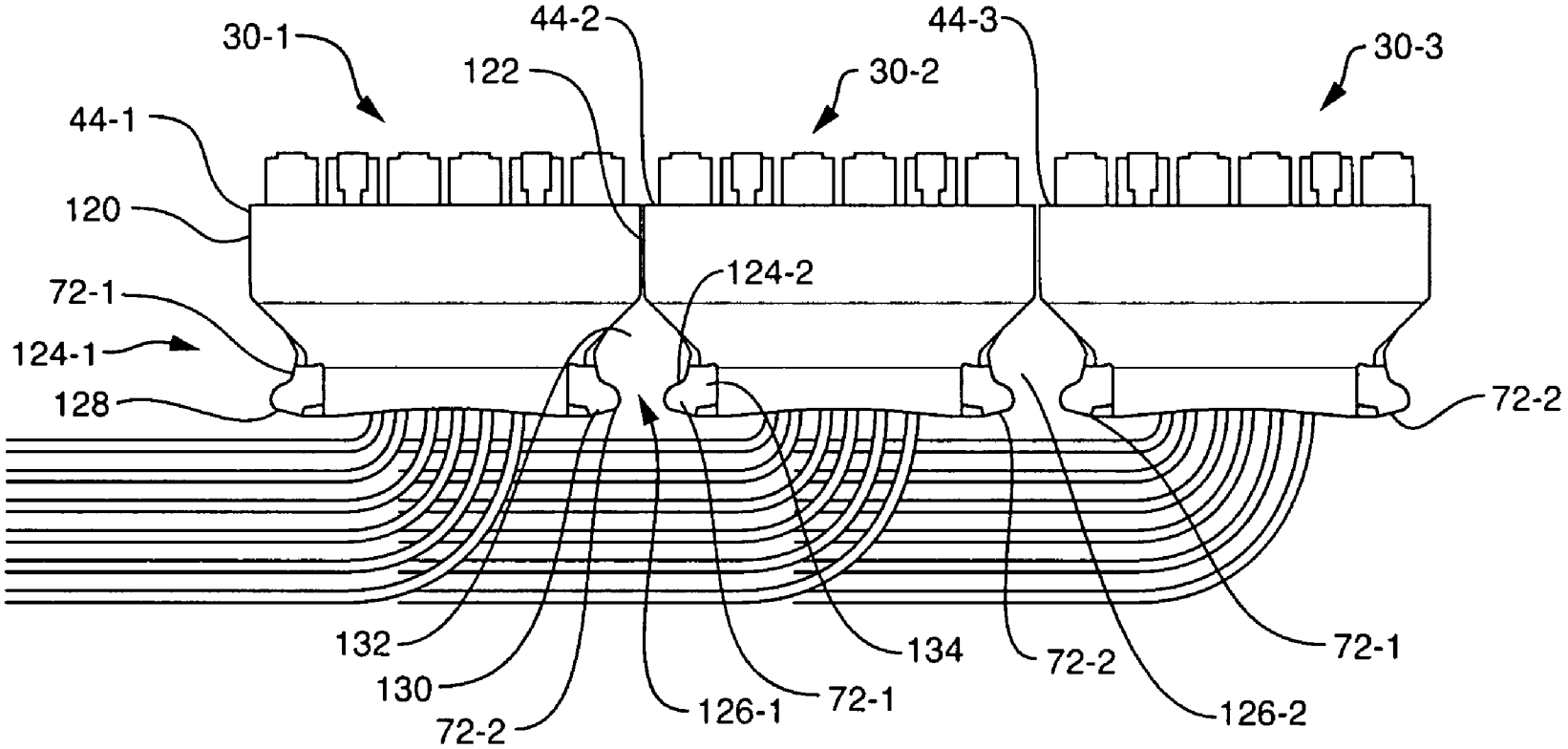
FIG. 7 illustrates a series of connector module assemblies arranged in a side-by-side configuration.

FIG. 7 illustrates an example of three connector module assemblies 30-1, 30-2, 30-3 oriented in a side-by-side manner, such as when coupled to the sets of ports 28-1, 28-2, 28-3 shown in FIG. 1. Each connector module assembly 30-1, 30-2, 30-3 includes a first lever 72-1 and a second lever 72-2 used to actuate the latches of certain connectors 36 housed by each connector module assembly. The housings 44-1, 44-2, 44-3 of the connector module assemblies 30-1, 30-2, 30-3 define concave portions in the side walls of the housings 44. For example, the first connector module assembly 30-1 has a first side wall 120 and a second side wall 122. The first side wall defines a first concave portion 124-1 and the second side wall defines a second concave portion 126-1. An actuator 128 of the first lever 72-1 of the first connector module assembly 30-1 orients within the first concave portion 124. Also, an actuator 130 of the second lever 72-2 of the first connector module assembly 30-1 orients within the second concave portion 124.

When the connector module assemblies 30-1, 30-2, 30-3 couple to a network interface circuit board in a side-by-side manner, adjacent concavities between adjacent connector module assemblies form "gaps" between the connector module assemblies 30. For example, as shown in FIG. 7, when the connector module assembly 30-1 mounts next to the connector module assembly 30-2, the concave portion 126-1 of the first connector module assembly 30-1 and a concave portion 126-2 of the second connector module assembly 30-2 forms a gap 132 between the housings 44-1, 4-2 of the connector module assemblies 30-1, 30-2. The gap 132 formed between the adjacent connector module assemblies 30-1, 30-2 allow a user or operator to readily access the actuator 130 of the first connector module assembly 30-1 and an actuator 134 of the second connector module assembly 30-2 using the operator's fingers. As such, the operator can access and depress the actuators to remove the connector module assemblies from a network interface circuit board without the use of tools.

While this invention has been particularly shown and described with references to preferred embodiments thereof, it will be understood by those skilled in the art that various changes in form and details may be made therein without departing from the spirit and scope of the invention as defined by the appended claims.

For example, as described with respect to FIG. 4, the frame 42 defines multiple openings 50 in a matrix pattern 54. As illustrated, the frame 42 defines two rows 56 of openings 50, each row having six openings 50 (e.g., openings 50-1 through 50-6 in a first row 56-1 and openings 50-7 through 50-12 in a second row 56-2). Such illustration is by way of example only. The matrix pattern 54 can correspond to other arrangements of ports 28 found on conventional network interface circuit boards 26. For example, in one arrangement, the frame 42 defines one row of two openings 50. In one arrangement, the frame 42 defines two rows 56 of openings 50, each row having four openings 50. In one arrangement, the frame 42 defines two rows 56 of openings 50, each row having eight openings 50.

What is claimed is:

1. A connector module comprising:

a frame defining a plurality of openings, the plurality of openings defined by the frame adapted to receive a corresponding plurality of cable connectors associated with a plurality of cables;

a housing coupled to the frame; and a lever coupled to the housing, the lever adapted to position a set of latches of the plurality of cable connectors (i) in a first position relative to corresponding connector ports to allow engagement of the plurality of cable connectors with the connector ports and (ii) in a second position relative to the connector ports to allow disengagement of the plurality of cable connectors from the connector ports;

wherein the lever comprises:

a first linkage member rotatable coupled to the frame, the first linkage member adapted to rotate about a first axis of rotation relative to the frame, and a second linkage member oriented in proximity to the first linkage member and rotatable coupled to the frame, the second linkage member adapted to rotate about a second axis of rotation relative to the frame, the second axis of rotation oriented substantially perpendicular to the first axis of rotation, rotation of the first linkage member about the first axis relative to the frame causing rotation of the second linkage member about the second axis of rotation relative to the frame, the second linkage member adapted to position the set of latches of the plurality of cable connectors (i) in the first position relative to corresponding connector ports to allow engagement of the plurality of cable connectors with the connector ports and (ii) in the second position relative to the connector ports to allow disengagement of the plurality of cable connectors from the connector ports.

2. The connector module of claim 1 wherein:

the lever is adapted to position a first set of latches of the plurality of cable connectors (i) in the first position relative to corresponding connector ports to allow engagement of the plurality of cable connectors with the connector ports and (ii) in the second position relative to the connector ports to allow disengagement of the plurality of cable connectors from the connector ports; and the frame comprises a latch locking portion, the latch locking portion adapted to engage a second set of latches of the plurality of cable connectors and retain the second set of latches in a depressed state relative to the connector ports.

3. The connector module of claim 1 wherein the housing comprises a retention mechanism and the frame comprises a retention mechanism support, the retention mechanism adapted to reside (i) in a first position relative to the retention mechanism support to attach the housing to the frame and (ii) in a second position relative to the retention mechanism support to detach the housing from the frame.

4. The connector module of claim 1 wherein the plurality of cable connectors comprise RJ45 cable connectors.

5. The connector module of claim 1 wherein the frame defines the plurality of openings in a matrix pattern, the matrix pattern selected from the group consisting of: one row defining two openings, two rows defining four openings per row, two rows defining six openings per row, and two rows defining eight openings per row.

6. The connector module of claim 1 wherein:

the housing comprises a first wall and a second wall opposing and oriented substantially parallel to the first wall, the first wall defining a concave portion relative to a planar surface of the first wall and the second wall defining a concave portion relative to a planar surface of the second wall; and the lever comprises a first lever coupled to the housing and a second lever coupled to the housing, the first lever having an actuation portion oriented within the concave portion defined by the first wall and the second lever having an actuation portion oriented within the concave portion defined by the second wall.

7. A connector module assembly comprising:

a plurality of cables, each of the plurality of cables having a corresponding cable connector;

a frame defining a plurality of openings, each cable connector of the plurality of cables inserted within a corresponding opening of the plurality of openings defined by the frame;

a housing coupled to the frame, the housing containing the plurality of cables and the housing and the frame aggregating the plurality of cables to allow engagement and disengagement of the cables, relative to corresponding connector ports, as a unit;

a lever coupled to the housing, the lever adapted to position a set of latches of the cable connectors (i) in a first position relative to corresponding connector ports to allow engagement of the cable connectors with the corresponding connector ports and (ii) in a second position relative to the connector port to allow disengagement of the cable connectors from the corresponding connector ports, wherein the lever comprises:

a first linkage member rotatable coupled to the frame, the first linkage member adapted to rotate about a first axis of rotation relative to the frame, and a second linkage member oriented in proximity to the first linkage member and rotatably coupled to the frame, the second linkage member adapted to rotate about a second axis of rotation relative to the frame, the second axis of rotation oriented substantially perpendicular to the first axis of rotation, rotation of the first linkage member about the first axis relative to the frame causing rotation of the second linkage member about the second axis of rotation relative to the frame, the second linkage member adapted to position the set of latches of the cable connectors (i) in the first position relative to corresponding connector ports to allow engagement of the plurality of cable connectors with the connector ports and (ii) in the second position relative to the connector ports to allow disengagement of the plurality of cable connectors from the connector ports.

8. The connector module assembly of claim 7 wherein:

the lever is adapted to position a first set of latches of the cable connectors (i) in the first position relative to corresponding connector ports to allow engagement of the plurality of cable connectors with the connector ports and (ii) in the second position relative to the connector ports to allow disengagement of the plurality of cable connectors from the connector ports; and the frame comprises a latch locking portion, the latch locking portion adapted to engage a second set of latches of the cable connectors and retain the second set of latches in a depressed state relative to the connector ports.

9. The connector module assembly of claim 7 wherein the housing comprises a retention mechanism and the frame comprises a retention mechanism support, the retention mechanism adapted to reside (i) in a first position relative to the retention mechanism support to attach the housing to the frame and (ii) in a second position relative to the retention mechanism support to detach the housing from the frame.

10. The connector module assembly of claim 7 wherein the cable connectors comprise RJ45 cable connectors.

11. The connector module assembly of claim 7 wherein the frame defines the plurality of openings in a matrix pattern, the matrix pattern selected from the group consisting of: one row defining two openings, two rows defining four openings per row, two rows defining six openings per row, and two rows defining eight openings per row.

12. The connector module assembly of claim 7 wherein:

the housing comprises a first wall and a second wall opposing and oriented substantially parallel to the first wall, the first wall defining a concave portion relative to a planar surface of the first wall and the second wall defining a concave portion relative to a planar surface of the second wall; and the lever comprises a first lever coupled to the housing and a second lever coupled to the housing, the first lever having an actuation portion oriented within the concave portion defined by the first wall and the second lever having an actuation portion oriented within the concave portion defined by the second wall.

13. A method for aggregating a plurality of cables comprising:

inserting cable connectors of a plurality of cables into a frame defining a plurality of openings, each cable connector of the plurality of cables inserted within a corresponding opening of the plurality of openings defined by the frame;

inserting the plurality of cables within a housing;

coupling the housing to the frame, the housing and the frame aggregating the plurality of cables to allow engagement and disengagement of the, cable connectors relative to corresponding connector ports, as a unit; and orienting a lever of the housing relative to a first a set of latches of the cable connectors, the lever adapted to position the set of latches of the cable connectors (i) in a first position relative to corresponding connector ports to allow engagement of the cable connectors with the connector ports and (ii) in a second position relative to the connector port to allow disengagement of the cable connectors from the corresponding connector ports, wherein the lever includes:

a first linkage member rotatable coupled to the frame, the first linkage member adapted to rotate about a first axis of rotation relative to the frame, and a second linkage member oriented in proximity to the first linkage member and rotatable coupled to the frame, the second linkage member adapted to rotate about a second axis of rotation relative to the frame, the second axis of rotation oriented substantially perpendicular to the first axis of rotation, rotation of the first linkage member about the first axis relative to the frame causing rotation of the second linkage member about the second axis of rotation relative to the frame, the second linkage member adapted to position the set of latches of the cable connectors (i) in the first position relative to corresponding connector ports to allow engagement of the plurality of cable connectors with the connector ports and (ii) in the second position relative to the connector ports to allow disengagement of the plurality of cable connectors from the connector ports.

14. The method of claim 13 comprising orienting a latch locking portion of the frame relative to latches of a second set of the cable connectors to engage the latches of the second set of cable connectors and retain the latches in a depressed state relative to the corresponding connector ports.

15. A computer system comprising:

a card cage, a back plane coupled to the card cage;

a circuit board having a plurality of connector ports; and a connector module assembly having:

a plurality of cables, each of the plurality of cables having a corresponding cable connector;

a frame defining a plurality of openings, each cable connector of the plurality of cables inserted within a corresponding opening of the plurality of openings defined by the frame;

a housing coupled to the frame, the housing containing the plurality of cables and the housing and the frame aggregating the plurality of cables and cable connectors, the plurality of cables and cable connectors coupled to the connector ports as a unit; and a lever coupled to the housing, the lever adapted to position a set of latches of the cable connectors (i) in a first position relative to corresponding connector ports to allow engagement of the cable connectors with the corresponding connector ports and (ii) in a second position relative to the connector port to allow disengagement of the cable connectors from the corresponding connector ports, wherein the lever comprises:

a first linkage member rotatable coupled to the frame, the first linkage member adapted to rotate about a first axis of rotation relative to the frame, and a second linkage member oriented in proximity to the first linkage member and rotatable coupled to the frame, the second linkage member adapted to rotate about a second axis of rotation relative to the frame, the second axis of rotation oriented substantially perpendicular to the first axis of rotation, rotation of the first linkage member about the first axis relative to the frame causing rotation of the second linkage member about the second axis of rotation relative to the frame, the second linkage member adapted to position the set of latches of the cable connectors (i) in the first position relative to corresponding connector ports to allow engagement of the plurality of cable connectors with the connector ports and (ii) in the second position relative to the connector ports to allow disengagement of the plurality of cable connectors from the connector ports.

16. A connector module comprising:

a frame defining a plurality of openings, the plurality of openings defined by the frame adapted to receive a corresponding plurality of cable connectors associated with a plurality of cables;

a housing coupled to the frame, the housing having a first wall and a second wall opposing and oriented substantially parallel to the first wall, the first wall defining a concave portion relative to a planar surface of the first wall and the second wall defining a concave portion relative to a planar surface of the second wall; and a lever coupled to the housing, the lever adapted to position a set of latches of the plurality of cable connectors (i) in a first position relative to corresponding connector ports to allow engagement of the plurality of cable connectors with the connector ports and (ii) in a second position relative to the connector ports to allow disengagement of the plurality of cable connectors from the connector ports, wherein the lever comprises a first lever coupled to the housing and a second lever coupled to the housing, the first lever having an actuation portion oriented within the concave portion defined by the first wall and the second lever having an actuation portion oriented within the concave portion defined by the second wall.

17. A connector module assembly comprising:

a plurality of cables, each of the plurality of cables having a corresponding cable connector;

a frame defining a plurality of openings, each cable connector of the plurality of cables inserted within a corresponding opening of the plurality of openings defined by the frame;

a housing coupled to the frame, the housing having a first wall and a second wall opposing and oriented substantially parallel to the first wall, the first wall defining a concave portion relative to a planar surface of the first wall and the second wall defining a concave portion relative to a planar surface of the second wall and the housing containing the plurality of cables and the housing and the frame aggregating the plurality of cables to allow engagement and disengagement of the cables, relative to corresponding connector ports, as a unit; and a lever coupled to the housing, the lever adapted to position a set of latches of the plurality of cable connectors (i) in a first position relative to corresponding connector ports to allow engagement of the plurality of cable connectors with the connector ports and (ii) in a second position relative to the connector ports to allow disengagement of the plurality of cable connectors from the connector ports, wherein the lever comprises a first lever coupled to the housing and a second lever coupled to the housing, the first lever having an actuation portion oriented within the concave portion defined by the first wall and the second lever having an actuation portion oriented within the concave portion defined by the second wall.

* * * * *

UNITED STATES PATENT AND TRADEMARK OFFICE

CERTIFICATE OF CORRECTION

PATENT NO. : 7,140,911 B1
APPLICATION NO. : 11/167660
DATED : November 28, 2006
INVENTOR(S) : Jack Brown Rector, III, Saeed Seyed and Luca Cafiero It is certified that error appears in the above-identified patent and that said Letters Patent is hereby corrected as shown below:

Title Page (75) Inventors: "Jack Rector"-- should read -- Jack Brown Rector, III --, and "Lucia Cafiero" -- should read -- Luca Cafiero --.

Column 8, Line 40, "rotatable" should read --rotatably--.
Column 8, Line 44, "rotatable" should read --rotatably--.
Column 9, Line 55, "rotatable" should read --rotatably--.
Column 9, Line 59, "rotatable" should read --rotatably--.
Column 11, Line 1, "rotatable" should read --rotatably--.
Column 11, Line 5, "rotatable" should read --rotatably--.
Column 11, Line 52, "rotatable" should read --rotatably--.
Column 11, Line 57, "rotatable" should read --rotatably--.

Signed and Sealed this

Tenth Day of April, 2007

JON W. DUDAS
*Director of the United States Patent and Trademark Office*